US009971280B2

(12) United States Patent
Yoshii

(10) Patent No.: US 9,971,280 B2
(45) Date of Patent: May 15, 2018

(54) DEVELOPER CASE AND IMAGE FORMING APPARATUS INCLUDING THE SAME

(71) Applicant: KYOCERA Document Solutions Inc., Osaka (JP)

(72) Inventor: Tatsuhiko Yoshii, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days. days.

(21) Appl. No.: 15/549,184

(22) PCT Filed: Dec. 11, 2015

(86) PCT No.: PCT/JP2015/084806

§ 371 (c)(1),
(2) Date: Aug. 7, 2017

(87) PCT Pub. No.: WO2016/132634

PCT Pub. Date: Aug. 25, 2016

(65) Prior Publication Data

US 2018/0024467 A1 Jan. 25, 2018

(30) Foreign Application Priority Data

Feb. 17, 2015 (JP) ..... 2015-028226

(51) Int. Cl.
*G03G 15/08* (2006.01)

(52) U.S. Cl.
CPC ..... *G03G 15/0887* (2013.01); *G03G 15/0879* (2013.01); *G03G 15/0896* (2013.01)

(58) Field of Classification Search
CPC ..... G03G 15/0877; G03G 15/0879
USPC ..... 399/258, 262, 263
See application file for complete search history.

(56) References Cited

U.S. PATENT DOCUMENTS 8,175,500 B2 * 5/2012 Okuda ..... G03G 15/0877 399/258

FOREIGN PATENT DOCUMENTS

JP 2010-096827 A 4/2010

* cited by examiner

*Primary Examiner* — William J Royer
(74) *Attorney, Agent, or Firm* — Studebaker & Brackett PC

(57) ABSTRACT

A developer case (10) according to the present invention includes a case main body (30), a conveyer (33), a first tube (34), and a second tube (35). The case main body (30) contains developer and has a discharge port (30*a*) to discharge the developer toward an outside of the case main body (30). The conveyer (33) conveys the developer in the case main body (30) toward the discharge port (30*a*). The first tube (34) is arranged in the case main body (30) so as to cover the discharge port (30*a*). The second tube (35) communicates with an inside of the first tube (34) at a downstream side of the discharge port (30*a*) in a conveying direction of the developer and extends in a direction crossing to the conveying direction.

8 Claims, 7 Drawing Sheets

DEVELOPER CASE AND IMAGE FORMING APPARATUS INCLUDING THE SAME

TECHNICAL FIELD

The present invention relates to a developer case suitably used for a copying machine and a printer, and an image forming apparatus which includes the developer case.

BACKGROUND ART

An image forming apparatus, such as a copying machine and a printer, develops a latent image on an image carrier by using developer (toner) to be supplied from a development device. The developer is contained in a developer case, and is supplied from the developer case to the development device.

Toner containers disclosed in Patent Document 1 each include a shutter attachment cylinder arranged on a wall surface of a container case which stores a toner. A toner discharge port is opened in a lower surface of the shutter attachment cylinder. In the container case, a toner conveying screw which conveys the toner to the toner discharge port is rotatably supported. The toner conveying screw is driven to rotate by a drive motor.

PRIOR ART DOCUMENT

Patent Document

[Patent Document 1] Japanese patent laid-open publication No. 2010-096827

SUMMARY OF INVENTION

Technical Problem

However, there is a case where, in each toner container disclosed in Patent Document 1, the toner near the toner discharge port condenses and a toner discharge failure (toner jamming) occurs. When conveyance of the toner continues in a state where the toner jamming occurs, an excessive load is applied to the toner conveying screw or a drive motor which rotates the toner conveying screw. Hence, each toner container disclosed in Patent Document 1 has a problem that the toner conveying screw or a drive system of the toner conveying screw is damaged.

To solve the above-mentioned problem, the present invention provides a developer case which suppresses a failure based on a discharge failure of developer, and an image forming apparatus which includes the above developer case.

Solution to Problem

A developer case according to the present invention includes, a case main body, a conveyer, a first tube, and a second tube. The case main body contains developer and has a discharge port to discharge the developer toward an outside of the case main body. The conveyer conveys the developer in the case main body toward the discharge port. The first tube is arranged in the case main body so as to cover the discharge port. The second tube communicates with an inside of the first tube at a downstream side of the discharge port in a conveying direction of the developer and extends in a direction crossing to the conveying direction.

An image forming apparatus according to the present invention includes the above developer case.

Advantageous Effects of Invention

According to the present invention, it is possible to suppress a failure based on a discharge failure of developer.

DESCRIPTION OF EMBODIMENTS

A preferred embodiment of the present invention will be described below with reference to the accompanying drawings. In this regard, the preferred embodiment will be described based on a direction shown in each drawing for ease of description. Further, an "upstream", a "downstream" and terms similar to the "upstream" and the "downstream" indicate the "upstream", the "downstream" and concepts of the "upstream" and the "downstream" in a conveying direction of a toner (developer).

Figure 1:
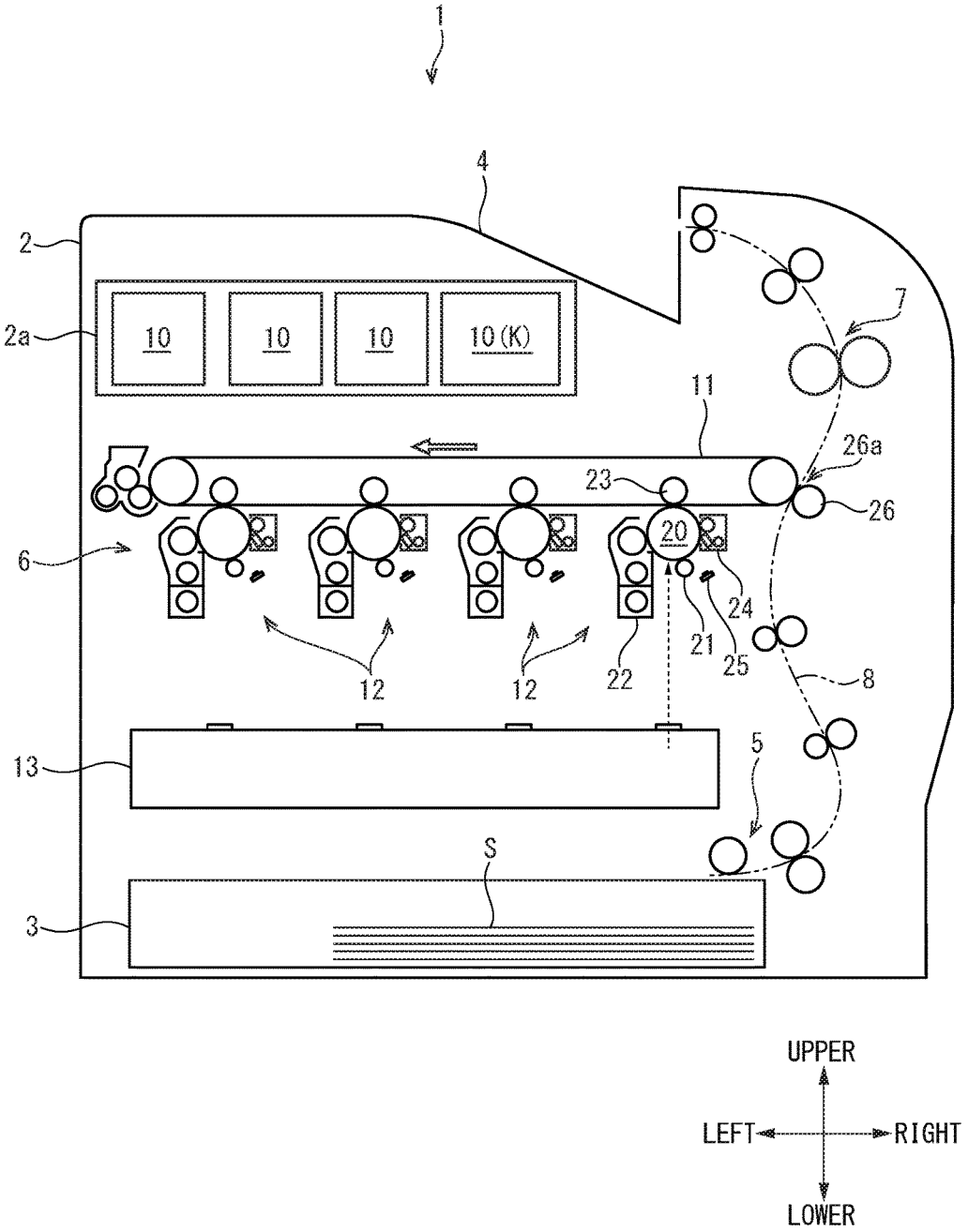
FIG. 1 is a front view schematically showing an inner structure of a color printer according to an embodiment of the present invention.

An entire configuration of a color printer 1 as an image forming apparatus will be described with reference to FIG. 1. FIG. 1 is a front view schematically showing an inner structure of the color printer 1.

The color printer 1 includes an apparatus main body 2, a sheet feeding cassette 3 and an ejection tray 4. The apparatus main body 2 is formed in a substantially rectangular box shape. The sheet feeding cassette 3 is provided at a lower part of the apparatus main body 2. The ejection tray 4 is provided at an upper part of the apparatus main body 2.

Further, the color printer 1 includes a conveying part 5, an image forming part 6 and a fixing device 7 inside the apparatus main body 2. The conveying part 5 feeds sheets S in the sheet feeding cassette 3 toward a conveying path 8 extended from the sheet feeding cassette 3 to the ejection tray 4. The image forming part 6 is provided at an intermediate part of the conveying path 8. The fixing device 7 is provided at a downstream side of the conveying path 8. In this regard, the sheets S are not limited to sheets made of paper, and include resin films and OHP (Over Head Projector) sheets.

The image forming part 6 includes four toner containers 10, an intermediate transfer belt 11, four drum units 12, and an optical scanning device 13. The four toner containers 10 are provided in a row in a left and right direction below the ejection tray 4. The intermediate transfer belt 11 is provided to be able to run in an outlined arrow direction below each toner container 10. The four drum units 12 are provided in a row in the left and right direction below the intermediate transfer belt 11. The optical scanning device 13 is disposed below each drum unit 12.

The four toner containers 10 contain four (yellow, magenta, cyanogen and black) toners (developers). In this regard, the toners may be one-component developer including a magnetic toner or may be two-component developer including a toner and a carrier.

The four drum units 12 are provided to correspond to the respective color toners. Each drum unit 12 is configured to include a photosensitive drum 20, a charging device 21, a development device 22, a primary transfer roller 23, a cleaning device 24 and a static eliminating device 25. In this regard, the four drum units 12 employ the same configuration, and therefore one drum unit 12 will be described below.

The photosensitive drum 20 is formed in a cylindrical shape which can rotate around an axis. The photosensitive drum 20 is in contact with a lower side face of the intermediate transfer belt 11. The charging device 21, the development device 22, the primary transfer roller 23, the cleaning device 24 and the static eliminating device 25 are disposed in a transfer process order around the photosensitive drum 20. The development device 22 is connected with the toner container 10 and receives replenishment of the toner from the toner container 10. The primary transfer roller 23 is disposed above the photosensitive drum 20 across the intermediate transfer belt 11. At a right side of the intermediate transfer belt 11, a secondary transfer roller 26 which forms a secondary transfer nip part 26*a* is disposed.

Hereinafter, an operation of the color printer 1 will be described. A controller (not shown) of the color printer 1 executes image forming processing as follows based on input image data.

Each charging device 21 charges a face of each photosensitive drum 20. The optical scanning device 13 performs exposure (see a broken line arrow in FIG. 1) corresponding to image data on each photosensitive drum 20. Each development device 22 develops an electrostatic latent image arranged on the face of each photosensitive drum 20 to a toner image. Each of four toner images carried by each photosensitive drum 20 is primarily transferred in order on the running intermediate transfer belt 11 by the primary transfer roller 23 to which a primary transfer bias has been applied. Thus, a full-color toner image is formed on the face of the intermediate transfer belt 11.

Meanwhile, the sheet S supplied from the sheet feeding cassette 3 is conveyed on the conveying path 8 and passes the secondary transfer nip part 26*a*. The full-color toner image is secondarily transferred on the sheet S by the secondary transfer roller 26 to which a secondary transfer bias has been applied. The fixing device 7 fixes the full-color toner image to the sheet S. The sheet S after the fixing processing is discharged to the ejection tray 4. Each cleaning device 24 removes the toner remaining on the face of each photosensitive drum 20 after the transfer. Each static eliminating device 25 radiates static eliminating light and eliminates charges of each photosensitive drum 20.

Figure 2:
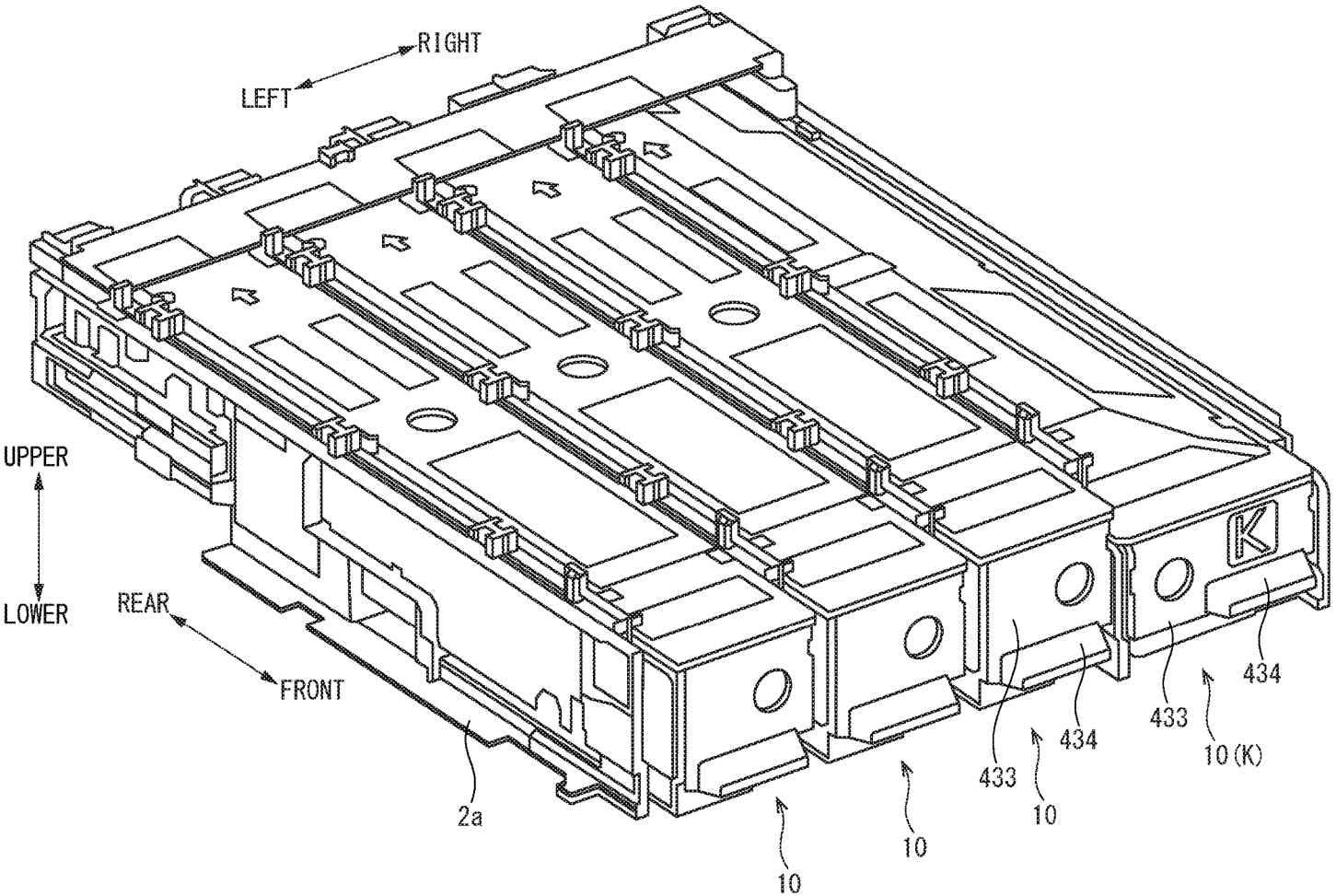
FIG. 2 is a perspective view showing toner containers and an attachment part according to the embodiment of the present invention.
Figure 3:
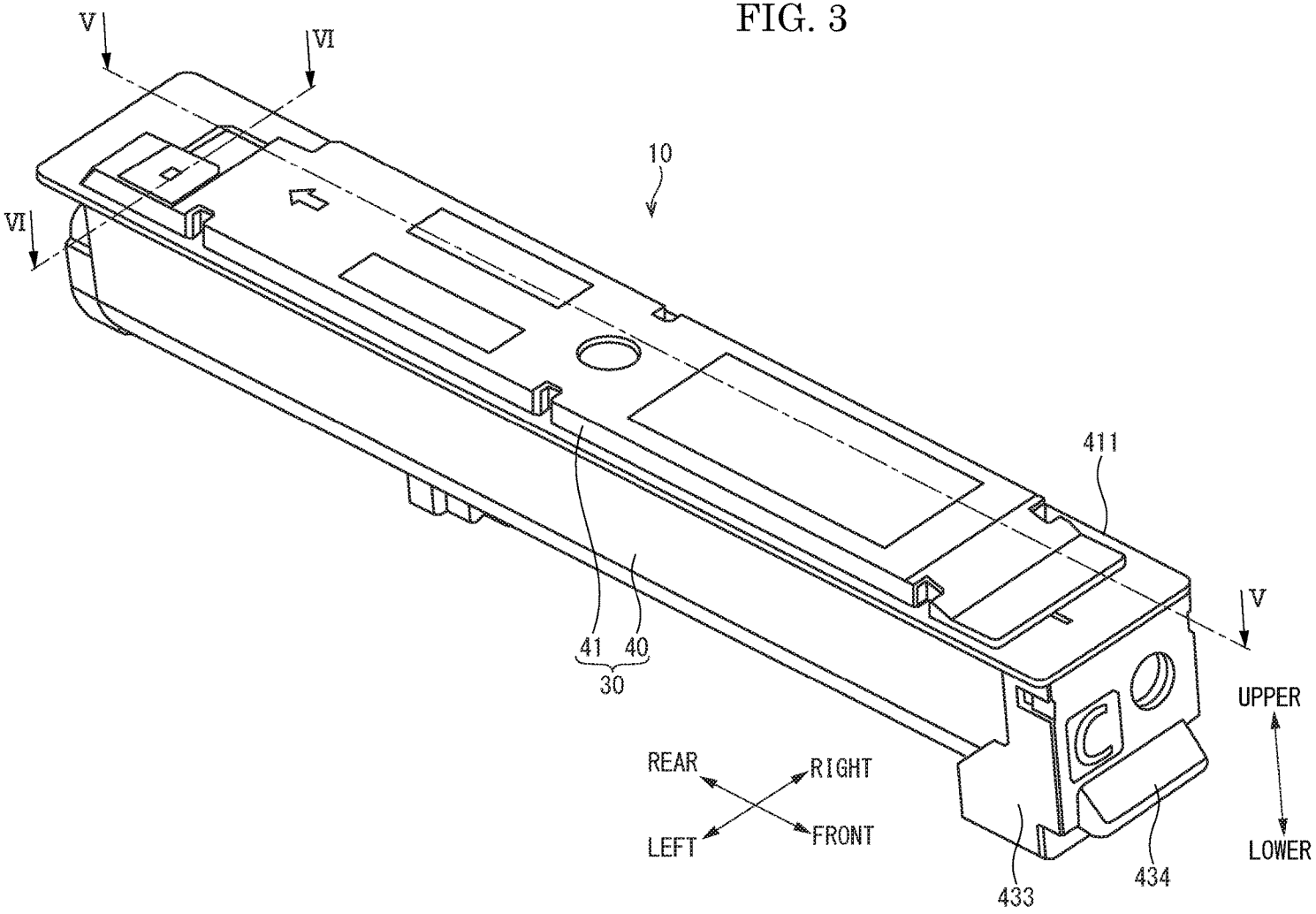
FIG. 3 is a perspective view showing the toner container according to the embodiment of the present invention.
Figure 4:
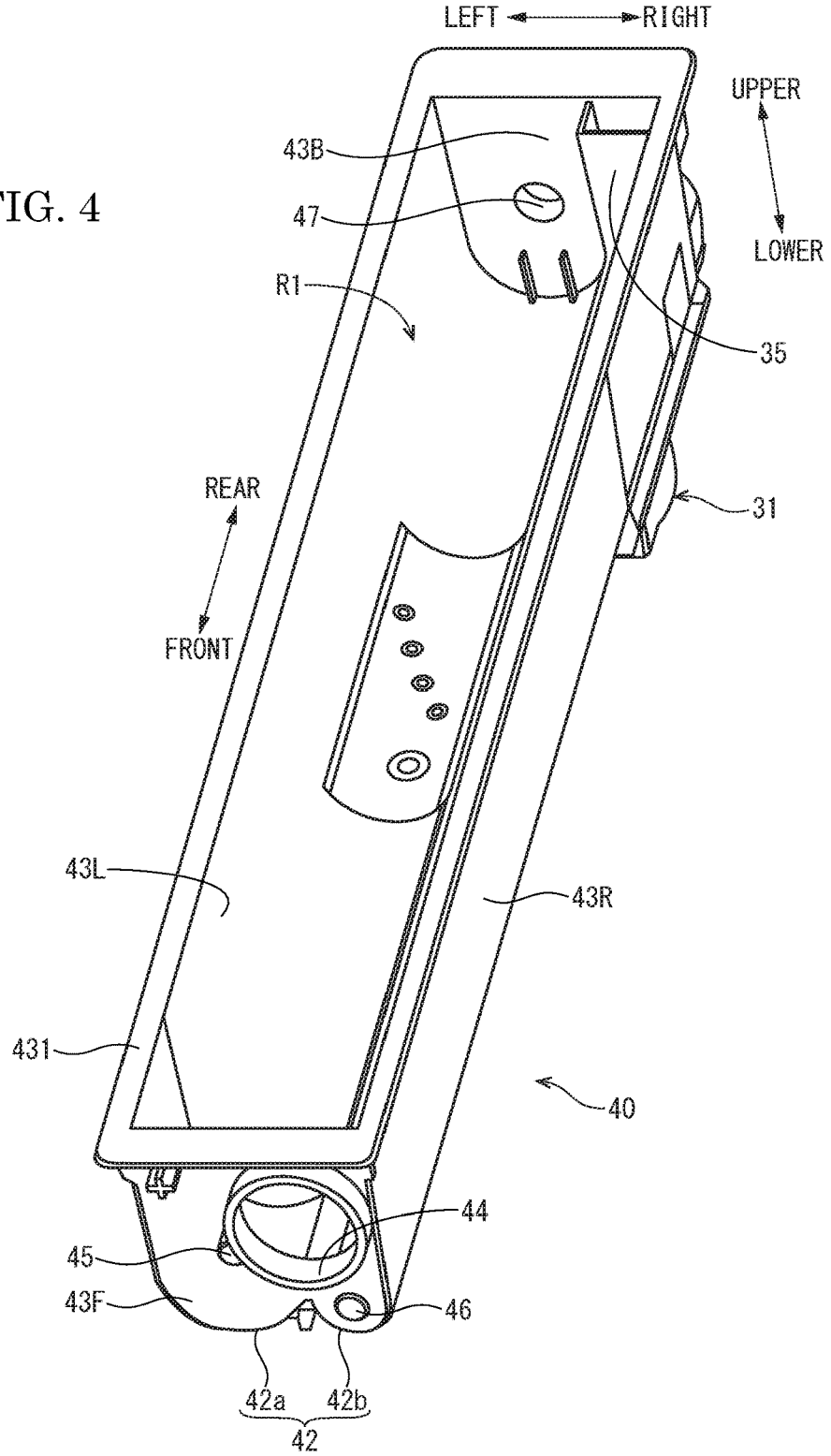
FIG. 4 is a perspective view showing a storing case of the toner container according to the embodiment of the present invention.
Figure 5:
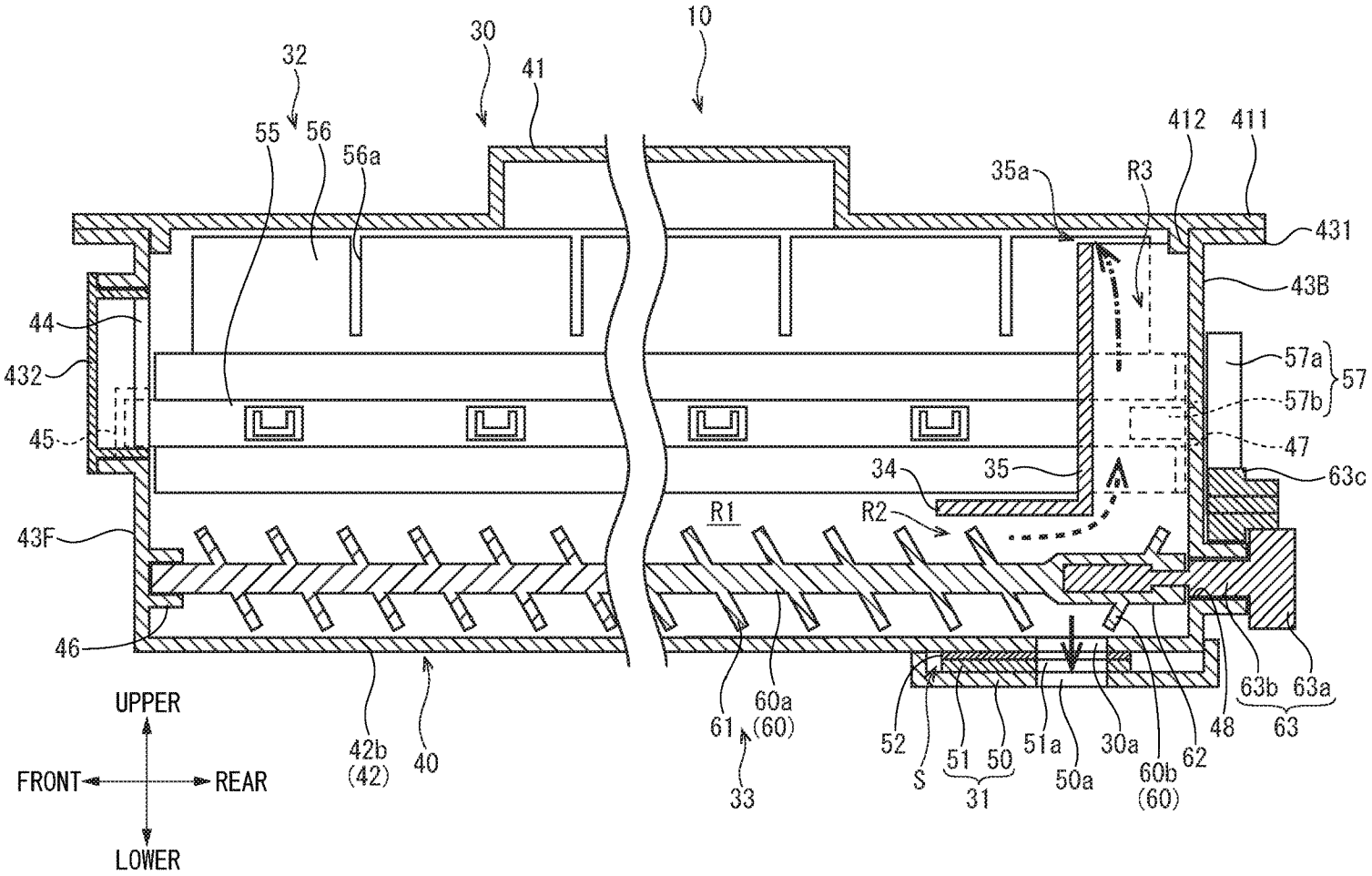
FIG. 5 is a sectional view taken along a V-V line in FIG. 3.
Figure 6:
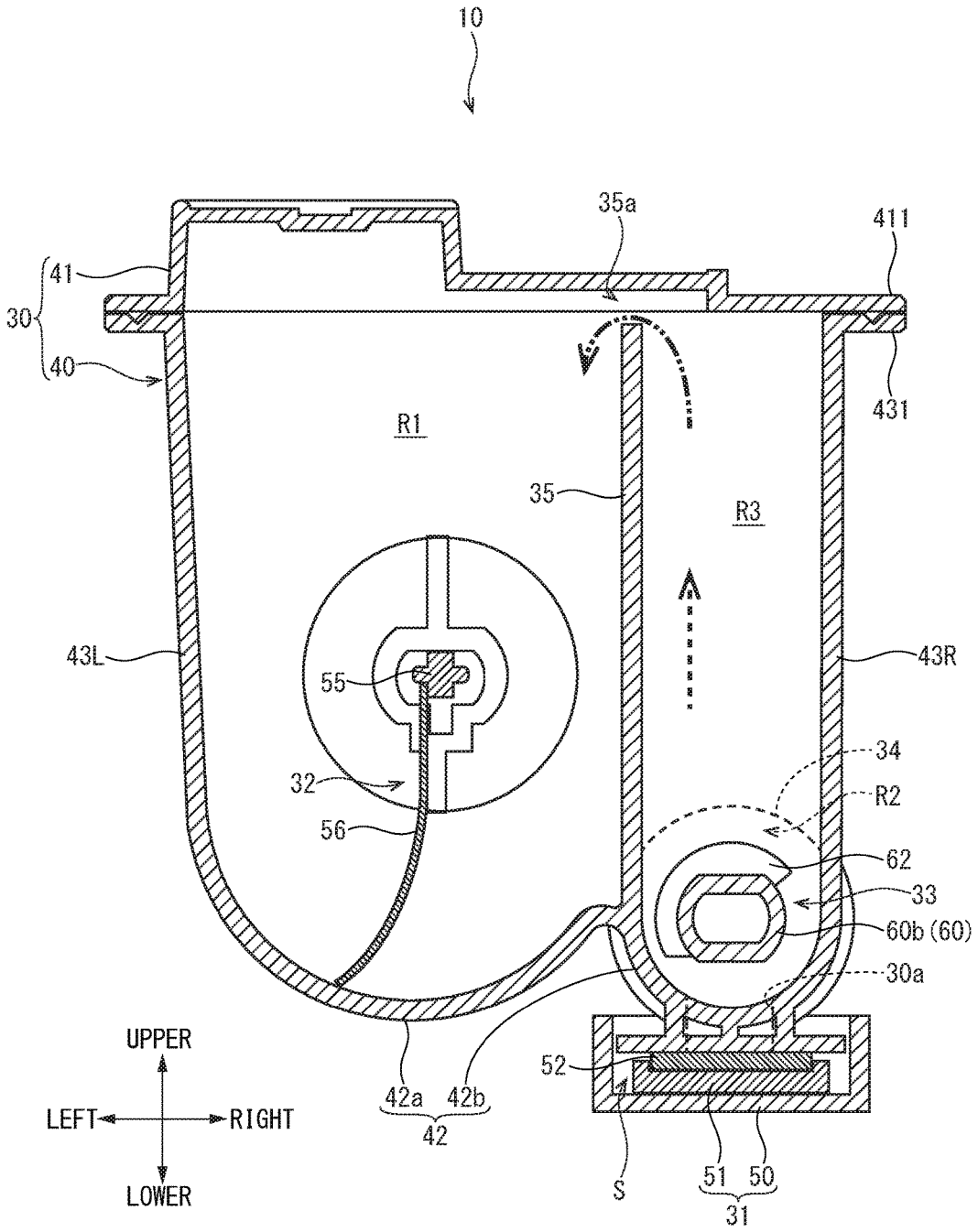
FIG. 6 is a sectional view taken along a VI-VI line in FIG. 3.
Figure 7:
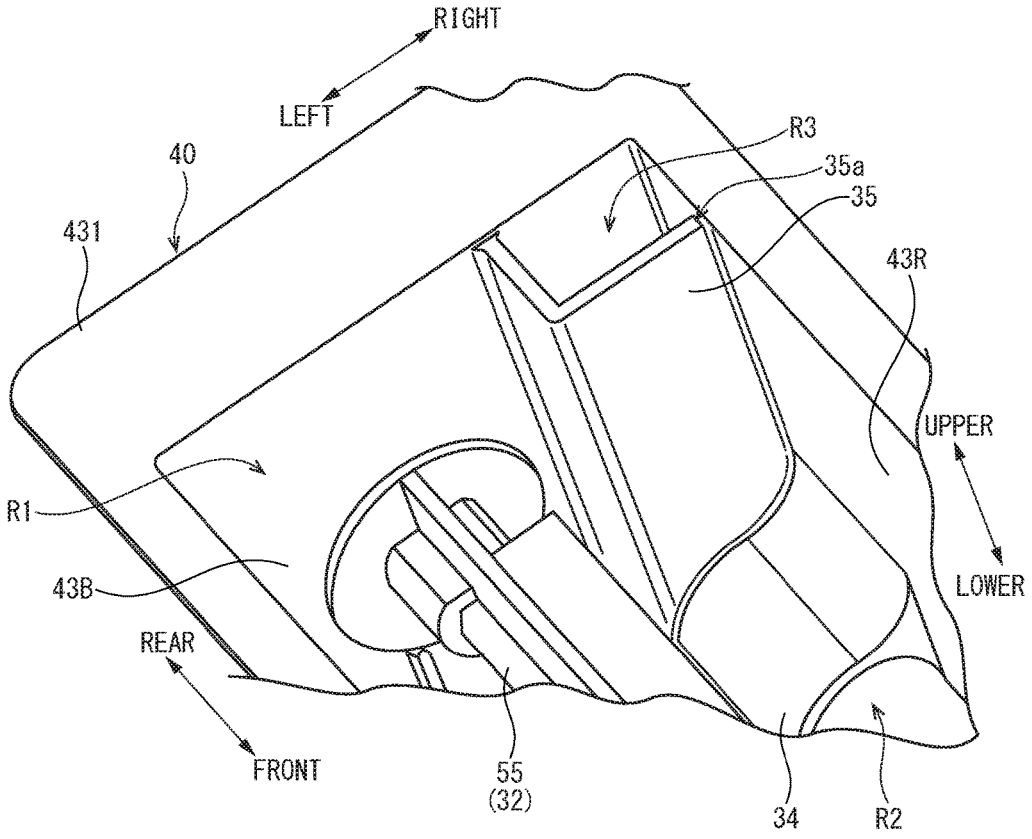
FIG. 7 is a perspective view showing a rear part of the storing case of the toner container according to the embodiment of the present invention.

Next, each toner container 10 as a developer case will be described with reference to FIGS. 1 to 7. FIG. 2 is a perspective view showing the toner containers 10 and an attachment part 2*a*. FIG. 3 is a perspective view showing the toner container 10. FIG. 4 is a perspective view showing a storing case 40 of the toner container 10. FIG. 5 is a sectional view taken along a V-V line in FIG. 3. FIG. 6 is a sectional view taken along a VI-VI line in FIG. 3. FIG. 7 is a perspective view showing a rear part of the storing case 40 of the toner container 10.

As shown in FIGS. 1 and 2, at the upper part of the apparatus main body 2, the attachment part 2*a* in which the four toner containers 10 are aligned in the left and right direction and attached is provided. Each toner container 10 is supported by the attachment part 2*a* in a slidable state in a front and rear direction. An upper front face of the apparatus main body 2 is provided with an opening/closing cover (not shown) to open and close the attachment part 2*a*. A user executes an operation of attaching and detaching each toner container 10 to and from the attachment part 2*a* by opening the opening/closing cover.

In this regard, the toner containers 10 which contain the toners of the respective color (yellow, magenta and cyanogen) except black (k) among the four toner containers 10 have the same volume and are set to the same specification. By contrast with this, the toner container 10 (K) which contains the black toner is set to a larger volume than the other toner containers 10, and has a different specification, too. However, the four toner containers 10 differ in the volumes and the specific specifications and employ the same basic configuration, and therefore the toner container 10 which contains the toner of each color except black will be described.

As shown in FIGS. 3 and 5, the toner container 10 is configured to include a case main body 30, a shutter mechanism 31, an agitator 32, a conveyer 33, a first tube 34 and a second tube 35. The case main body 30 contains the toner (developer) and includes a discharge port 30*a* through which the toner is discharged to the development device 22. The shutter mechanism 31 is provided to open and close the discharge port 30*a* of the case main body 30. The agitator 32 agitates the toner in the case main body 30. The conveyer 33 conveys the toner in the case main body 30 toward the discharge port 30*a*. The first tube 34 and the second tube 35 are provided in the case main body 30.

As shown in FIG. 3, the case main body 30 is formed in a substantially cuboid shape which is long in the front and rear direction by using a synthetic resin material, for example. The case main body 30 includes the storing case 40 and a lid 41. The storing case 40 includes sidewalls 43F, 43B, 43L and 43R erected around a bottom 42, and is formed in a box shape with an opened upper face (see FIG. 4). The lid 41 is provided to seal the upper face of the storing case 40. Inside the case main body 30, a storing room R1 in which the toner is stored is arranged (see FIG. 4).

As shown in FIG. 4, the bottom 42 includes an agitating recess part 42*a* and a conveying recess part 42*b* which are curved so as to protrude downward when seen from a front view. The agitating recess part 42*a* continues to a left side of the conveying recess part 42*b* when seen from the front view, and is formed larger in the left and right direction than the conveying recess part 42*b*. In a rear lower surface of the conveying recess part 42*b*, the discharge port 30*a* is opened (see FIGS. 5 and 6). The discharge port 30*a* is arranged so as to penetrate the conveying recess part 42*b* in an upper and lower direction.

At upper ends of the sidewalls 43F, 43B, 43L and 43R, a case side flange 431 extending outward when seen from a plan view is arranged. In the front sidewall 43F, a loading port 44 through which the toner is loaded in the case main body 30 (storing room R1) is opened. The loading port 44 is sealed by a cap 432 (see FIG. 5). A cover 433 which covers the loading port 44 is attached to the front sidewall 43F (see FIG. 3). A grip part 434 which the user grips to attach or detach the toner container 10 is arranged on the cover 433 (see FIG. 2). In this regard, on a face of the cover 433, a letter (symbol) indicating the toner color is embossed.

As shown in FIG. 5, an agitating bearing boss 45 and a conveying bearing boss 46 are arranged in the front sidewall 43F. The agitating bearing boss 45 is arranged so as to protrude in a cylindrical shape on an outer face (front face) of the sidewall 43F. The agitating bearing boss 45 is arranged near a curvature center of the agitating recess part 42*a* when seen from the front view (see FIG. 4). The conveying bearing boss 46 is arranged so as to protrude in a cylindrical shape on an inner face (rear face) of the sidewall 43F. The conveying bearing boss 46 is arranged near a curvature center of the conveying recess part 42*b* when seen from the front view (see FIG. 4). In the rear sidewall 43B, an agitating support hole 47 and a conveying support hole 48 are arranged. The agitating support hole 47 is arranged near the curvature center of the agitating recess part 42*a* when seen from the front view (see FIG. 4). The conveying support hole 48 is arranged near the curvature center of the conveying recess part 42*b* when seen from the front view.

As shown in FIG. 3, the lid 41 is formed in the substantially same shape as that of the storing case 40 when seen from the plan view. At an entire periphery of a lower part of the lid 41, a lid side flange 411 is arranged. The lid 41 is disposed such that the lid side flange 411 faces the case side flange 431. Both of the flanges 411 and 431 are bonded by an adhesive (or welding processing) to fix the lid 41 to the storing case 40 (see FIGS. 5 and 6).

As shown in FIGS. 5 and 6, the shutter mechanism 31 includes a holding member 50 and a shutter 51.

The holding member 50 is formed in a substantially box shape which is flat in the upper and lower direction with an opened upper face. The holding member 50 is attached to a lower face of the conveying recess part 42*b* so as to cover the surroundings of the discharge port 30*a*. Between a bottom face of the holding member 50 and the lower face of the conveying recess part 42*b*, an installation space S in which the shutter 51 and the like are disposed is arranged. A first communication hole 50*a* is arranged at a position of the holding member 50 meeting the discharge port 30*a* when seen from a bottom view. The first communication hole 50*a* is arranged so as to penetrate the holding member 50 in the upper and lower direction.

The shutter 51 is formed in a substantially rectangular shape when seen from the plan view. On an upper face of the shutter 51, a seal 52 formed by using a synthetic rubber is fixed. The shutter 51 is held in the installation space S in a slidable state in the front and rear direction. At a part (rear side) of the shutter 51 (seal 52), a second communication hole 51*a* which penetrates in the upper and lower direction is arranged. The shutter 51 is slidable between an opening position at which the second communication hole 51*a* matches with the discharge port 30*a* (see FIG. 5), and a closed position at which the second communication hole 51*a* is displaced from the discharge port 30*a*.

Although not shown, the holding member 50 is provided with a biasing member which biases the shutter 51 and the like toward the closed position. Hence, in a state where the toner container 10 is detached from the attachment part 2*a*, the shutter 51 is kept in a state where the shutter 51 moves to the closed position, and the seal 52 comes into close contact with the periphery part of the discharge port 30*a*. Consequently, it is possible to prevent leakage of the toner from the discharge port 30*a*. Meanwhile, in a process of attaching the toner container 10 to the attachment part 2*a*, the shutter 51 engages with an engagement part (not shown) provided to the attachment part 2*a*, and moves from the closed position to the opening position (see FIG. 5). Thus, the discharge port 30*a* connects to a toner conveying path (not shown) which extends from the development device 22 via each of the communication holes 50*a* and 51*a*. Further, the toner discharged from the discharge port 30*a* is replenished to the development device 22 through the toner conveying path.

As shown in FIGS. 5 and 6, the agitator 32 is disposed on the agitating recess part 42*a*. The agitator 32 includes an agitating rotation shaft 55, an agitating blade 56 and an agitating coupling 57. The agitating rotation shaft 55 is rotatably supported around an axis in the case main body 30. The agitating blade 56 is fixed along a longitudinal direction of the agitating rotation shaft 55. The agitating coupling 57 is provided on a coaxial center of the agitating rotation shaft 55.

The agitating rotation shaft 55 is formed in a bar shape which is long in the front and rear direction by using a synthetic resin, for example. The agitating rotation shaft 55 is formed in a substantially rectangular shape when seen from the front view (sectional view). The agitating rotation shaft 55 is bridged between a pair of front and rear sidewalls 43F and 43B. A front end of the agitating rotation shaft 55 is rotatably supported by the agitating bearing boss 45. A rear end of the agitating rotation shaft 55 is rotatably supported in the agitating support hole 47 via the agitating coupling 57.

The agitating blade 56 is formed in a rectangular shape which is long in the front and rear direction by using a synthetic resin film having flexibility. The agitating blade 56 is formed to have the substantially same length as that of the agitating rotation shaft 55. One side in the longitudinal direction of the agitating blade 56 is fixed to the agitating rotation shaft 55. A width dimension of the agitating blade 56 (a dimension in a radial direction of the agitating rotation shaft 55) is set to be longer than a distance which connects an axial center of the agitating rotation shaft 55 and an inner face of the agitating recess part 42*a* (see FIG. 6). Further, on the agitating blade 56, a plurality of cut grooves 56*a* are arranged (see FIG. 5). Each cut groove 56*a* is cut from a free end side of the agitating blade 56 to a fixing side of the agitating rotation shaft 55.

As shown in FIG. 5, the agitating coupling 57 includes an agitating gear 57*a* and an agitating coupling shaft 57*b*. The agitating gear 57*a* is a so-called spur gear, and is disposed along a rear surface of the sidewall 43B. Although described in detail below, the agitating gear 57*a* is driven to rotate by a drive motor (not shown) provided in the apparatus main body 2. The agitating coupling shaft 57*b* is provided so as to protrude from a rotation axial center of the agitating gear 57*a*. The agitating coupling shaft 57*b* is inserted in the agitating support hole 47 of the sidewall 43B from a rear side, and is rotatably supported by the agitating support hole 47. A distal end (front end) of the agitating coupling shaft 57*b* is unrotatably coupled to a rear end (axial center part) of the agitating rotation shaft 55.

As shown in FIGS. 5 and 6, the conveyer 33 is disposed on the conveying recess part 42*b*. The conveyer 33 includes a conveying rotation shaft 60, a first blade 61, a second blade 62 and a conveying coupling 63. The conveying rotation shaft 60 is supported by the case main body 30 rotatably around the axis in the case main body 30. The first blade 61 and the second blade 62 are formed in spiral shapes, and are provided on a circumferential face of the conveying rotation shaft 60. The second blade 62 is provided in a reverse direction to a direction of the first blade 61. The conveying coupling 63 is provided on the same axial center as that of the conveying rotation shaft 60.

The conveying rotation shaft 60 is formed in a round bar shape which is long in the front and rear direction by using a synthetic resin material, for example. The conveying rotation shaft 60 is bridged between the pair of front and rear sidewalls 43F and 43B. The conveying rotation shaft 60 includes a rotation shaft part 60*a* and a fitting shaft part 60*b* which are formed integrally.

The rotation shaft part 60*a* extends from the front end to a proximity of the discharge port 30*a*. A front end of the rotation shaft part 60*a* is rotatably supported in the conveying bearing boss 46. The fitting shaft part 60*b* continues to a rear end of the rotation shaft part 60*a*. The fitting shaft part 60*b* has the same axial center as that of the rotation shaft part 60*a*, and is formed in a hollow cylindrical shape which is thicker than the rotation shaft part 60*a*. The fitting shaft part 60*b* is rotatably supported in the conveying support hole 48 via the conveying coupling 63. In this regard, a connection part of the rotation shaft part 60*a* and the fitting shaft part 60*b* is positioned above (a front side of) the discharge port 30*a* (see FIG. 5).

The first blade 61 is formed integrally with the rotation shaft part 60*a* by using a synthetic resin material, for example. The first blade 61 protrudes in the radial direction from a circumferential face of the rotation shaft part 60*a*, and is formed in a spiral shape along the longitudinal direction of the rotation shaft part 60*a*. In more detail, the first blade 61 is fixed between a front end of the conveying rotation shaft 60 and the discharge port 30*a* (see FIG. 0.5).

The second blade 62 is formed integrally with the fitting shaft part 60*b* by using a synthetic resin material, for example. The second blade 62 protrudes in the radial direction from a circumferential face of the fitting shaft part 60*b*, and is formed in a spiral shape of one or two turns. The second blade 62 is arranged such that its spiral direction is a reverse direction (reverse phase) to that of the first blade 61. The second blade 62 is formed to have the same diameter as that of the first blade 61 when seen from the front view. The second blade 62 is arranged on the circumferential face of the fitting shaft part 60*b* at a downstream side (rear side) of the discharge port 30*a* (see FIG. 5). In this regard, above the discharge port 30*a*, the first blade 61 and the second blade 62 are not provided (see FIG. 5).

As shown in FIG. 5, the conveying coupling 63 includes a conveying gear 63*a* and a conveying coupling shaft 63*b*. The conveying gear 63*a* is a so-called spur gear, and is disposed along a rear face of the sidewall 43B. The conveying gear 63*a* is coupled to a drive mechanism (not shown) including a drive gear and a gear train provided in the apparatus main body 2. The conveying gear 63*a* connects (meshes) with the agitating gear 57*a* via an intermediate gear 63*c*. The conveying coupling shaft 63*b* is provided so as to protrude from a rotation axial center of the conveying gear 63*a*. The conveying coupling shaft 63*b* is inserted in the conveying support hole 48 of the sidewall 43B from the rear side, and is rotatably supported in the conveying support hole 48. A distal end (front end) of the conveying coupling shaft 63*b* unrotatably fits to a hollow inner part of the fitting shaft part 60*b* of the conveying rotation shaft 60.

Drive force of the drive motor rotates the conveying gear 63*a* (conveying coupling shaft 63*b*). The rotation of the conveying gear 63*a* rotates the agitating gear 57*a* (agitating coupling shaft 57*b*) via the intermediate gear 63*c*. Thus, the agitating coupling 57 and the agitating rotation shaft 55 integrally rotate around the same axial center. Then, the agitating blade 56 slides on an inner face of the agitating recess part 42*a* while elastically curving (see FIG. 6). That is, the agitating blade 56 agitates the toner in the storing room R1 while scraping the toner adhered to the inner face of the agitating recess part 42*a*. Similarly, the conveying coupling 63 and the conveying rotation shaft 60 integrally rotate around the same axial center. Then, the first blade 61 conveys the toner agitated by the agitator 32 to the discharge port 30*a* (from a front side to a rear side). When conveyed to the discharge port 30*a*, the toner is blocked by the rotation of the second blade 62. By this means, the toner is collected to the discharge port 30*a*, and is smoothly discharged from the discharge port 30*a* to an outside (development device 22) of the case main body 30.

As described above, the first blade 61 exerts on the toner the conveying force which travels toward the downstream side (rear side) and the second blade 62 exerts on the toner the conveying force which travels toward the upstream side (front side). Further, as described above, the fitting shaft part 60*b* to which the second blade 62 is fixed is formed to have a larger diameter than that of the rotation shaft part 60*a* to which the first blade 61 is fixed. Hence, the conveying force of the first blade 61 is set to be larger than the conveying force of the second blade 62.

As shown in FIGS. 5 to 7, the first tube 34 is formed integrally with a rear end of the conveying recess part 42*b* by using a synthetic resin material, for example. The first tube 34 is arranged so as to cover the discharge port 30*a*. That is, the first tube 34 is formed in a substantially cylindrical shape which extends in the front and rear direction (horizontal direction) together with the conveying recess part 42*b*. Inside the first tube 34, a conveying room R2 which rotatably includes a rear end of the conveyer 33 is arranged. The inner diameter of the first tube 34 is formed slightly larger than the outer diameter of the first blade 61 of the conveyer 33.

The toner in the storing room R1 is fed into the first tube 34 (conveying room R2) by the rotating conveyer 33, and is discharged from the discharge port 30*a* to the development device 22 (see FIG. 5). The discharge port 30*a* is covered by the first tube 34, and therefore an excessive amount of the toner is not carried to the discharge port 30*a*. That is, the first tube 34 is provided to adjust the toner amount (replenishment amount) discharged from the discharge port 30*a*. Consequently, it is possible to prevent the toner from being excessively replenished to the development device 22.

As shown in FIGS. 5 to 7, the second tube 35 is formed integrally with the storing case 40 by using a synthetic resin material, for example. The second tube 35 is connected to the rear sidewall 43B and the right sidewall 43R, and is connected to an upper part of the first tube 34. That is, the second tube 35 is formed in a rectangular shape which extends from an upper circumferential face of the first tube 34 to an upper side in a vertical direction along each of the sidewalls 43B and 43R. The second tube 35 communicates with the inside (conveying room R2) of the first tube 34 at the downstream side (rear side) of the discharge port 30*a* (see FIG. 5). In more detail, the second tube 35 communicates with the first tube 34 at a position at which the second tube 35 overlaps with a rear side of the discharge port 30*a* when seen from a side view.

Inside the second tube 35, an evacuation room R3 which communicates with the conveying room. R2 is arranged. That is, the evacuation room. R3 expands the volume of the conveying room R2 to an upper side. Between an upper end of the second tube 35 and a lower face of the lid 41, a gap 35*a* is formed as a through opening. The gap 35*a* is opened at a front side and a left side of the second tube 35. The gap 35*a* directly communicates the evacuation room R3 and the storing room R1. In this regard, the upper end of the second tube 35 engages with a positioning protrusion 412 which is provided so as to protrude from the lower face of the lid 41 at a side of the sidewall 43B of the evacuation room R3 (see FIG. 5).

Next, a function of the toner container 10 will be described with reference to FIGS. 5 and 6.

When the toner is consumed by executing the image forming processing, the controller of the color printer 1 executes an operation of replenishing the toner to the development device 22 as follows. The controller performs driving control on the drive motor and the drive motor rotates the agitator 32 and the conveyer 33. The conveyer 33 conveys the toner agitated by the agitator 32 to the toner discharge port 30*a*. By this means, the toner is introduced in the conveying room R2 of the first tube 34, and is replenished from the opened discharge port 30*a* to the development device 22 through the toner conveying path.

By the way, there is a case where the toner is jammed in the discharge port 30*a* and a toner discharge failure (toner jamming) occurs. When the toner continues to be conveyed in this case, the toner cannot be discharged (or a toner discharge amount extremely decreases), and therefore an excessive load is applied to the conveyer 33 or the drive motor which rotates the conveyer 33. Hence, the toner container 10 according to the present embodiment solves the above problem by evacuating the conveyed toner from the conveying room R2 to the evacuation room R3.

When, for example, the conveyer 33 continues rotating in a state where the toner discharge failure occurs, the toner is fed to the downstream side (rear side) beyond the discharge port 30*a*, and receives conveying force of an opposite direction by the rotation of the second blade 62. Hence, the toner overflows from the conveying room R2 of the first tube 34, and is introduced to the evacuation room R3 of the second tube 35 (see broken line bold arrows in FIGS. 5 and 6).

In this regard, the conveying force (absolute value) of the second blade 62 is set to be smaller than the conveying force (absolute value) of the first blade 61, so that the toner does not reversely flow. The toner is blocked by the conveying force (forward force) of the second blade 62, and is pushed out from the inside of the first tube 34 (conveying room R2) into the second tube 35 (evacuation room. R3) by the conveying force of the first blade 61. The toner does not reversely flow and can evacuate from the conveying room. R2 to the evacuation room R3. Consequently, even when the toner continues being conveyed in the state where the toner discharge failure occurs, an excessive load is not applied to the conveyer 33 and the drive motor which drives the conveyer 33.

When the conveyer 33 further continues rotating in the state where the toner discharge failure occurs, the toner continues flowing from the conveying room. R2 to the evacuation room R3. Further, the toner accumulates in the evacuation room R3. When the toner fills the evacuation room R3, the toner is discharged from the gap 35*a* at an upper part to the storing room R1 (see two-dot chain lines in FIGS. 5 and 6). That is, the toner overflowing from the evacuation room R3 can evacuate to the storing room R1. Hence, the toner filling the evacuation room. R3 does not apply an excessive load to the conveyer 33 and the drive motor which drives the conveyer 33. Consequently, it is possible to protect the conveyer 33 and the drive motor.

In the toner container 10 according to the above-mentioned present embodiment, the second tube 35 communicates with the inside of the first tube 34, so that the toner (developer) overflowing from the inside of the conveying room R2 of the first tube 34 can evacuate in the evacuation room R3 of the second tube 35. Hence, even when the toner continues being conveyed in the state where the toner discharge failure occurs, it is possible to reduce a load exerted on the conveyer 33 and the drive motor. Consequently, it is possible to prevent the conveyer 33 and the drive motor from being damaged.

Further, in the toner container 10 according to the present embodiment, the second tube 35 extends from the circumferential face of the first tube 34 to the upper side in the vertical direction. Hence, when the toner is discharged well (normal time), the toner to be conveyed does not enter the second tube 35 provided at an upward posture, and is normally discharged from the discharge port 30*a*. Consequently, it is possible to stabilize a toner discharge amount during the normal time.

In this regard, the toner container 10 according to the present embodiment includes the second tube 35 which provided upright toward the upper side in the vertical direction. However, the present invention is not limited to this. The second tube 35 may extend from the circumferential face of the first tube 34 in a direction which crosses to (which may not be perpendicular to) a conveying direction. For example, the second tube 35 may incline with respect to the first tube 34.

In this regard, the gap 35*a* is arranged between the second tube 35 and the lid 41 according to the present embodiment. However, the present invention is not limited to this. For example, instead of the gap 35*a*, a through opening (not shown) which penetrates the side face of the second tube 35 may be arranged.

In addition, the above-mentioned embodiment describes one aspect of the developer case according to the present invention and the image forming apparatus which includes the developer case. The technical scope of the present invention is not limited to the above embodiment. The components in the above-mentioned embodiment can be optionally replaced or combined with existing components, and the description of the above-mentioned embodiment does not limit the contents of the invention recited in the claims.

The invention claimed is:

1. A developer case comprising:

a case main body containing developer and having a discharge port to discharge the developer toward an outside of the case main body;

a conveyer conveying the developer in the case main body toward the discharge port;

a first tube arranged in the case main body so as to cover the discharge port; and a second tube communicating with an inside of the first tube at a downstream side of the discharge port in a conveying direction of the developer and extending in a direction crossing to the conveying direction, wherein the conveyer includes:

a rotation shaft rotatably supported by the case main body;

a first blade arranged on a circumferential face of the rotation shaft and exerting conveying force on the developer toward a downstream side of the conveying direction; and a second blade arranged on the circumferential face of the rotation shaft at the downstream side of the discharge port in the conveying direction and exerting conveying force on the developer toward an upstream side of the conveying direction, wherein the first blade is fixed between one end of the rotation shaft and the discharge port, wherein the first tube extends in a horizontal direction, and the second tube extends upward from a circumferential face of the first tube, wherein a storing room in which the developer is stored is arranged inside the case main body, and an evacuation room communicating with the inside of the first tube is arranged inside the second tube, and the second tube is provided with a through opening to directly communicate the storing room and the evacuation room, wherein the case main body includes:

a storing case formed in a box shape with an opened upper face; and a lid sealing the upper face of the storing case, and the through opening is formed between an upper end of the second tube and a lower face of the lid.

2. The developer case according to claim 1, wherein the conveying force of the first blade is set to be larger than the conveying force of the second blade.

3. The developer case according to claim 1, wherein a protrusion protruding from the lower face of the lid engages with the upper end of the second tube.

4. The developer case according to claim 1, wherein the second tube is formed integrally with the case main body.

5. The developer case according to claim 1, further comprising a conveying coupling member which rotates integrally with the rotation shaft, wherein the rotation shaft includes:

a rotation shaft part formed integrally with the first blade; and a fitting shaft part to which the conveying coupling member fits, the fitting shaft part being formed integrally with the second blade, wherein a connection part of the rotation shaft part and the fitting shaft part is positioned above the discharge port.

6. The developer case according to claim 1, wherein the second tube communicates with the first tube at a position at which the second tube overlaps with the discharge port.

7. The developer case according to claim 1, wherein the first blade and the second blade are not provided above the discharge port, wherein the second blade is fixed between another end of the rotation shaft and the discharge port.

8. An image forming apparatus comprising the developer case according to claim 1.

* * * * *